US009537272B2

(12) United States Patent
Chien et al.

(10) Patent No.: US 9,537,272 B2
(45) Date of Patent: Jan. 3, 2017

(54) REINFORCING STRUCTURE OF ELECTRICAL RECEPTACLE CONNECTOR

(71) Applicant: ADVANCED-CONNECTEK INC., New Taipei (TW)

(72) Inventors: Min-Lung Chien, New Taipei (TW); Ming-Yung Chang, New Taipei (TW); Tsung-Hsun Hsieh, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/602,942

(22) Filed: Jan. 22, 2015

(65) Prior Publication Data

US 2015/0207281 A1 Jul. 23, 2015

(30) Foreign Application Priority Data

Jan. 23, 2014 (TW) ..... 103201435 U

(51) Int. Cl.

| | |
|---|---|
| ***H01R 24/00*** | (2011.01) |
| ***H01R 24/62*** | (2011.01) |
| ***H01R 13/502*** | (2006.01) |
| *H01R 107/00* | (2006.01) |

(52) U.S. Cl.

CPC ..... *H01R 24/62* (2013.01); *H01R 13/502* (2013.01); *H01R 2107/00* (2013.01)

(58) Field of Classification Search

CPC ..... H01R 13/514; H01R 24/62
USPC ..... 439/676, 357, 17, 19, 348, 66
See application file for complete search history.

(56) References Cited

U.S. PATENT DOCUMENTS

| | | | | |
|---|---|---|---|---|
| 6,413,112 | B2 * | 7/2002 | Semmeling | H01R 13/6275 439/357 |
| 7,581,980 | B2 * | 9/2009 | Chiu | H01R 13/502 439/466 |
| 8,152,566 | B1 * | 4/2012 | Little | H01R 13/6582 439/607.41 |
| 8,827,742 | B2 * | 9/2014 | Wang | H01R 24/68 439/569 |
| 8,956,187 | B2 * | 2/2015 | He | H01R 13/504 439/607.35 |
| 8,961,235 | B2 * | 2/2015 | Little | H01R 13/64 439/374 |
| 9,088,108 | B2 * | 7/2015 | Zhao | H01R 13/6581 |
| 9,093,797 | B2 * | 7/2015 | Zhao | H01R 12/707 |

(Continued)

*Primary Examiner* — Tulsidas C Patel
*Assistant Examiner* — Peter G Leigh
(74) *Attorney, Agent, or Firm* — Muncy, Geissler, Olds & Lowe, PC.

(57) ABSTRACT

A reinforcing structure of an electrical receptacle connector includes an insulation housing, a terminal group, and a reinforcing sheet. The insulation housing includes a substrate and a tongue portion extending to one side of the substrate. The tongue portion includes a top surface, a bottom surface, and a front side surface between the top surface and the bottom surface. The terminal group is provided on the bottom surface, and includes a power supply terminal and a grounding terminal. A contact wall is formed between the power supply terminal and the front side surface, and the reinforcing sheet is provided on the top surface. The reinforcing sheet includes a front baffle and a recessed portion, the front baffle is fixed on the front side surface, and the recessed portion inwardly curves to be formed on the front baffle and corresponds to the contact wall.

5 Claims, 9 Drawing Sheets

(56) References Cited

U.S. PATENT DOCUMENTS

| | | | | |
|---|---|---|---|---|
| 9,106,024 | B2 * | 8/2015 | Zhao | H01R 13/6594 |
| 9,203,176 | B2 * | 12/2015 | Dong | H01R 13/516 |
| 9,391,391 | B2 * | 7/2016 | Chien | H01R 13/5202 |
| 2011/0195606 | A1 * | 8/2011 | Hsia | H01R 13/6581 439/660 |
| 2012/0252281 | A1 * | 10/2012 | Hsia | H01R 13/6581 439/660 |
| 2013/0183844 | A1 * | 7/2013 | Wang | H01R 24/68 439/271 |
| 2014/0073184 | A1 * | 3/2014 | Zhao | H01R 13/6581 439/607.55 |
| 2014/0073190 | A1 * | 3/2014 | Zhao | H01R 13/6594 439/626 |
| 2014/0099835 | A1 * | 4/2014 | Chang | H01R 13/6581 439/682 |
| 2014/0113497 | A1 * | 4/2014 | Wang | H01R 13/52 439/660 |
| 2014/0187094 | A1 * | 7/2014 | Zhao | H01R 13/6581 439/626 |
| 2014/0187105 | A1 * | 7/2014 | Zhao | H01R 12/707 439/733.1 |
| 2015/0194761 | A1 * | 7/2015 | Xie | H01R 24/60 439/521 |

* cited by examiner

100

REINFORCING STRUCTURE OF ELECTRICAL RECEPTACLE CONNECTOR

CROSS-REFERENCES TO RELATED APPLICATIONS

This non-provisional application claims priority under 35 U.S.C. §119(a) on Patent Application No. 103201435 filed in Taiwan, R.O.C. on 2014 Jan. 23, the entire contents of which are hereby incorporated by reference.

FIELD OF THE INVENTION

The present invention relates to an electrical receptacle connector, and more particular, to a reinforcing structure of an electrical receptacle connector.

BACKGROUND

A commonly used electrical connector interface is a universal serial bus (Universal Serial Bus, USB). In order to be smaller and portable, a micro USB electrical connector is developed, which is usually equipped with a connection hole and a corresponding transmission line for various portable electronic apparatuses such as a smart mobile communications device and a digital camera.

The existing micro USB electrical receptacle connector has an insulation housing and a tongue piece structure in the front of the insulation housing, and the connector is usually connected to an electrical plug connector by the tongue piece structure and multiple terminals located above tongue piece structure the. The tongue piece structure needs to be reinforced so as to avoid the tongue piece from fracturing and improve the service life.

The micro USB electrical receptacle connector provided on the existing electronic product has a reinforcing metal sheet for covering the tongue piece, so as to reinforce the structure. However, after the electrical plug connector is plugged into the electrical receptacle connector multiple times, the conductive terminal provided on the electrical plug connector constantly rubs the front end of the tongue piece of the electrical receptacle connector, so that the front end of the tongue piece gradually becomes thinner. As a result, the conductive terminals of the electrical plug connector contact the reinforcing metal sheet, causing a short circuit of the electronic product. Therefore, the related manufactories need to find a solution and solve the problem of the conventional structure.

SUMMARY OF THE INVENTION

In view of the above problem, the present invention provides a reinforcing structure of an electrical receptacle connector, so as to solve a short circuit problem caused by a reinforcing sheet of the conventional electrical receptacle connector easily contacting conductive terminals of an electrical plug connector.

The present invention provides a reinforcing structure of an electrical receptacle connector, which includes an insulation housing, a terminal group, and a reinforcing sheet. The insulation housing includes a substrate and a tongue portion extending to one side of the substrate. The tongue portion includes a top surface, a bottom surface, and a front side surface between the top surface and the bottom surface. The terminal group is provided on the bottom surface, and includes a power supply terminal and a grounding terminal. A contact wall is formed between the power supply terminal and the front side surface, and the reinforcing sheet is provided on the top surface. The reinforcing sheet includes a front baffle and a recessed portion, the front baffle is fixed on the front side surface, and the recessed portion inwardly curves to be formed on the front baffle and corresponds to the contact wall.

The present invention also provides a reinforcing structure of an electrical receptacle connector, which includes an insulation housing, a terminal group, and a reinforcing sheet. The insulation housing includes a substrate and a tongue portion extending to one side of the substrate. The tongue portion includes a top surface, a bottom surface, and a front side surface between the top surface and the bottom surface. The terminal group is provided on the bottom surface, and includes a power supply terminal and a grounding terminal. A contact wall is formed between the grounding terminal and the front side surface, and the reinforcing sheet is provided on the top surface. The reinforcing sheet includes a front baffle and a recessed portion, the front baffle is fixed on the front side surface, and the recessed portion inwardly curves to be formed on the front baffle and corresponds to the contact wall.

In the present invention, a recessed portion inwardly curves to be formed on a front baffle and corresponds to a contact wall, and an inner surface of the recessed portion is lower than an edge of the front baffle at the horizontal height; in this way, after an electrical plug connector is plugged in and unplugged many times, conductive terminals are prevented from contacting the inner surface of the recessed portion of a reinforcing sheet when being inserted into the concave contact wall, thereby avoiding a short circuit of an electronic product if the conductive terminals contact the reinforcing sheet. Moreover, the contact wall is provided with a bump structure fit with the recessed portion, and the bump increases the thickness and distance to rub the contact wall, thereby reducing a short circuit risk caused by the reinforcing sheet contacting the conductive terminals. In addition, side baffles, corner baffles, and the front baffle of the reinforcing sheet are integrally connected and fixed on a tongue portion, thereby increasing the strength of the tongue portion and preventing the tongue portion from fracturing during plugging and unplugging.

Detailed description of the characteristics and the advantages of the present invention is shown in the following embodiments, the technical content and the implementation of the present invention should be readily apparent to any person skilled in the art from the detailed description, and the purposes and the advantages of the present invention should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

Figure 1:
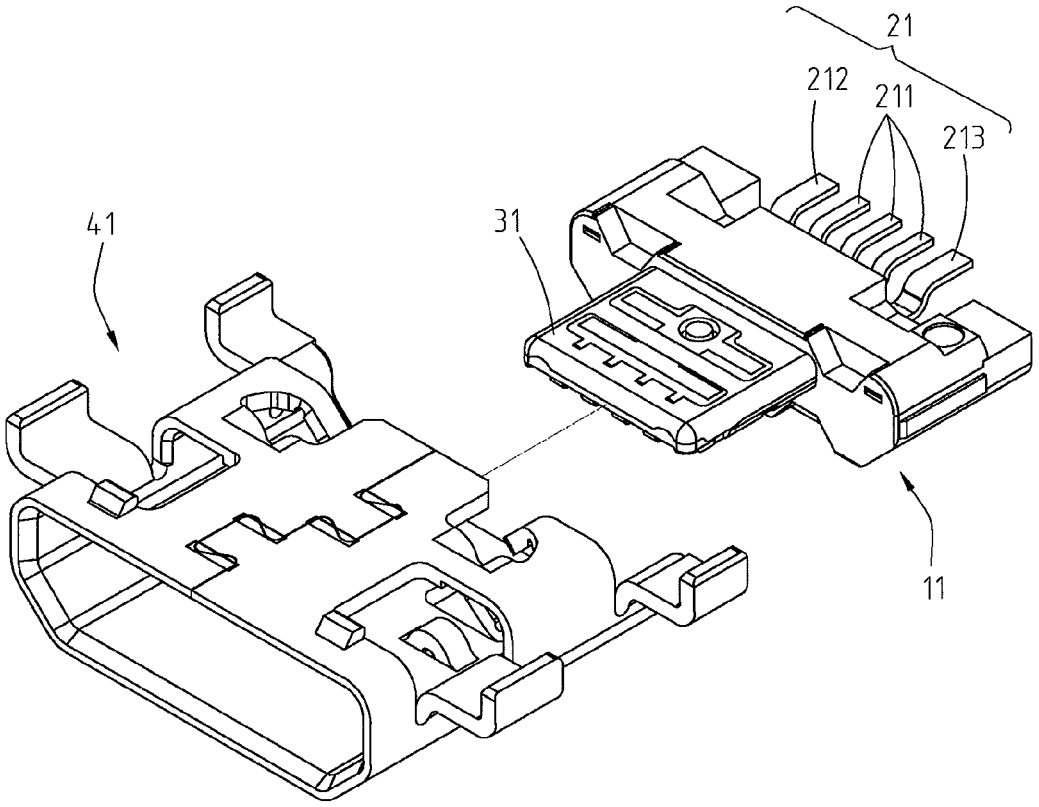
FIG. 1 is an exploded view of a rear side of the present invention.
Figure 2:
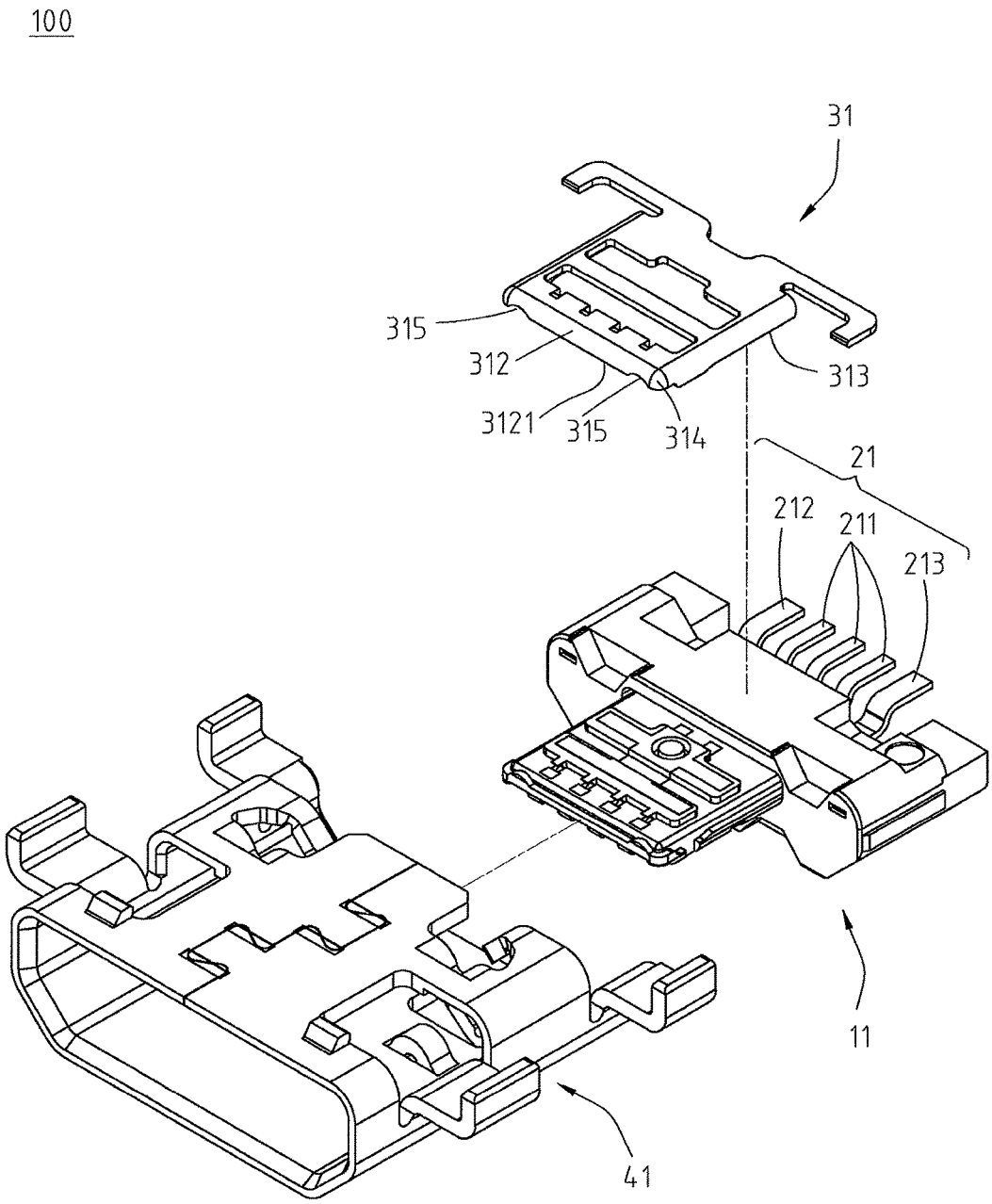
FIG. 2 is another exploded view of the rear side of the present invention.

FIG. 1 is an exploded view of a rear side and FIG. 2 is another exploded view of the rear side. FIGS. 1 and 2 show an embodiment of an electrical receptacle connector 100 of the present invention. The electrical receptacle connector 100 of the present invention may be a miniature connection interface such as a mini USB interface or a micro USB interface, but the present invention is not limited thereto. In use, the electrical receptacle connector 100 may also be a common USB connection interface.

The electrical receptacle connector 100 may be applied to an electronic product such as a mobile communications device or a notebook computer. In this embodiment, a reinforcing structure of the electrical receptacle connector 100 mainly comprise an insulation housing 11, a terminal group 21, and a reinforcing sheet 31; moreover, the outside of the insulation housing 11 is combined with a shell 41, and the insulation housing 11 is connected to a circuit board (not shown) by the shell 41 and the terminal group 21.

Figure 3:
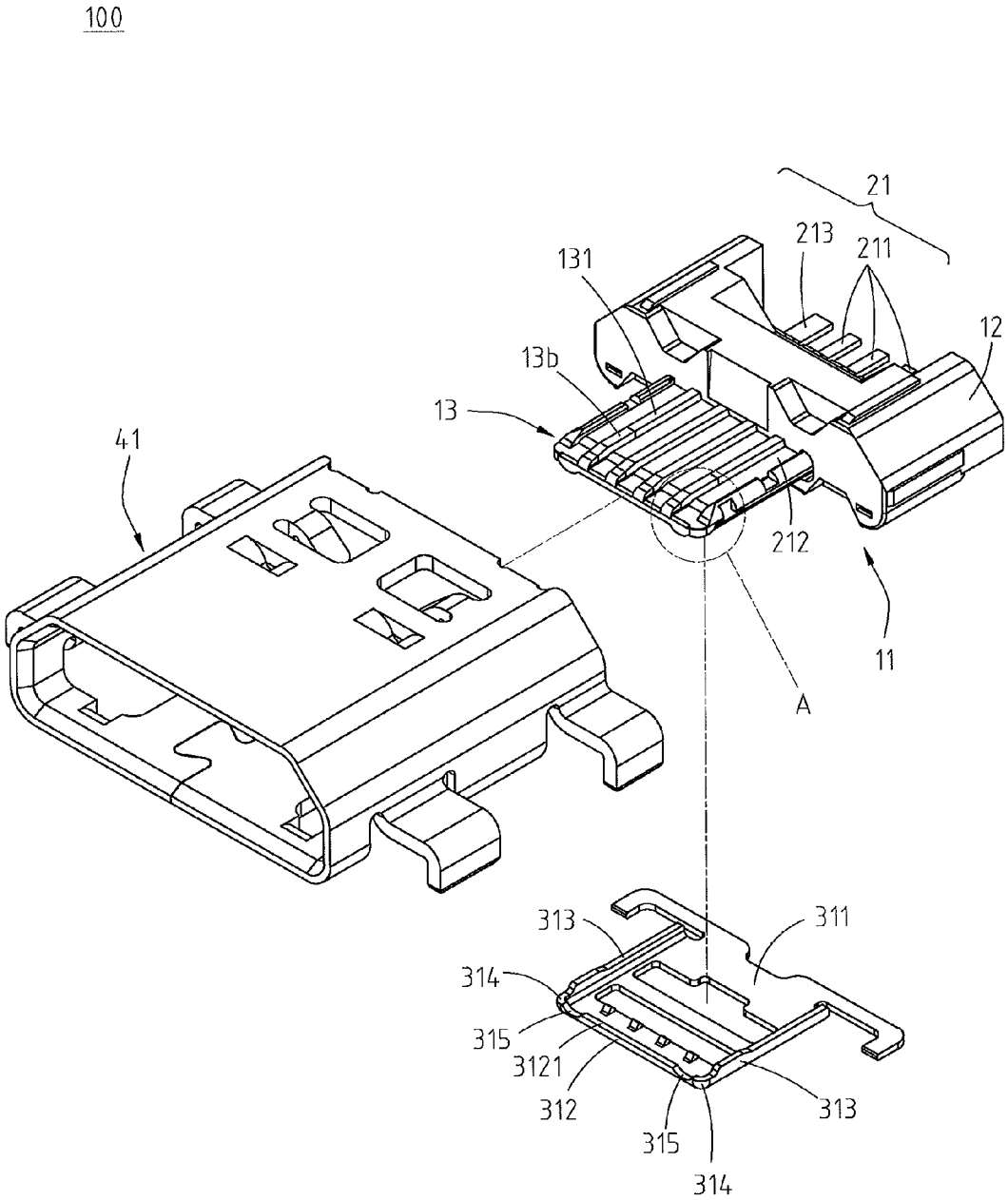
FIG. 3 is an exploded view of a front side of the present invention.
Figure 3A:
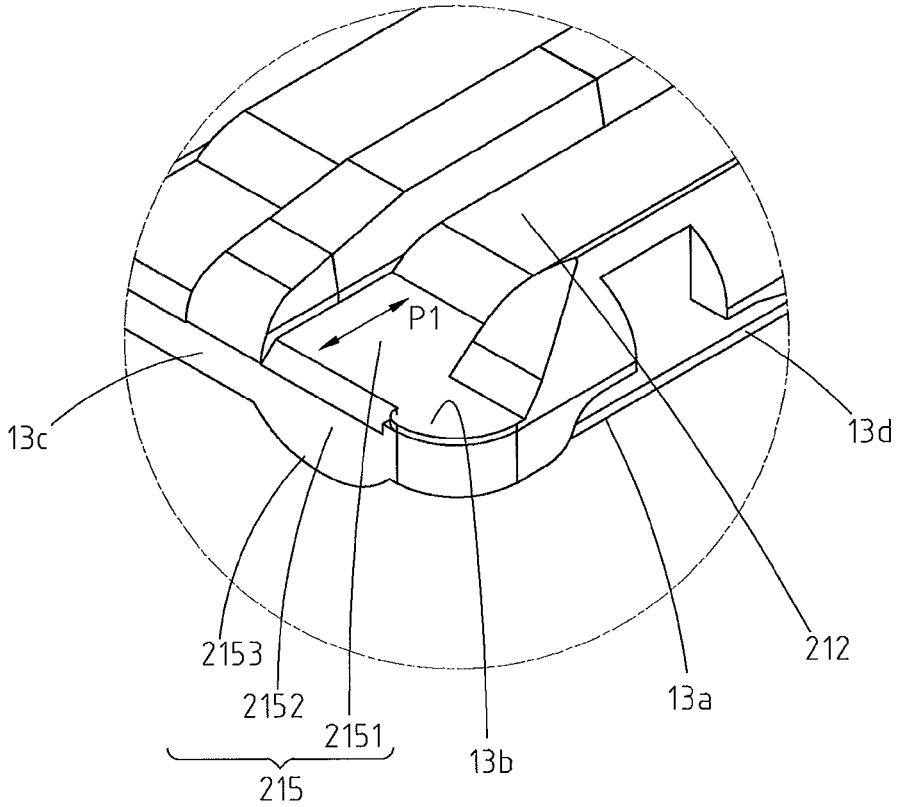
FIG. 3A is an enlarged cross-sectional view of part "A" in FIG. 3.
Figure 4:
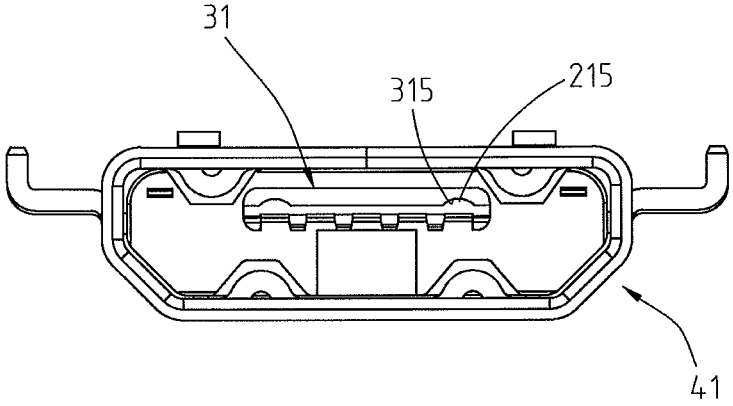
FIG. 4 is a front view of the present invention.
Figure 5:
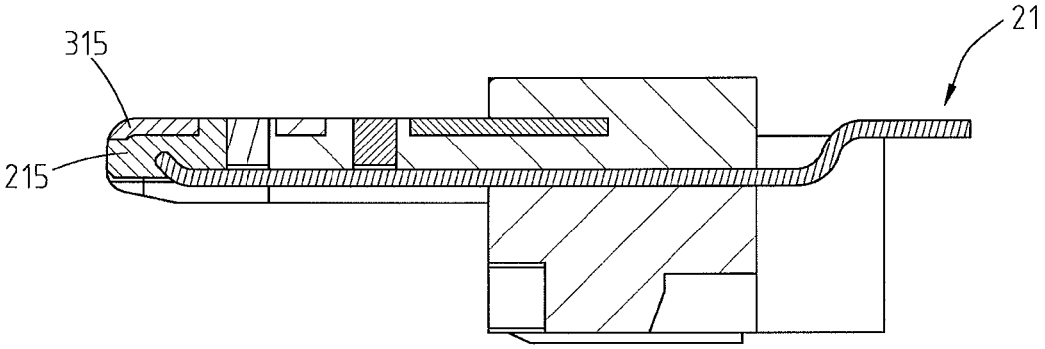
FIG. 5 is a partial cross-sectional side view of the present invention.
Figure 6:
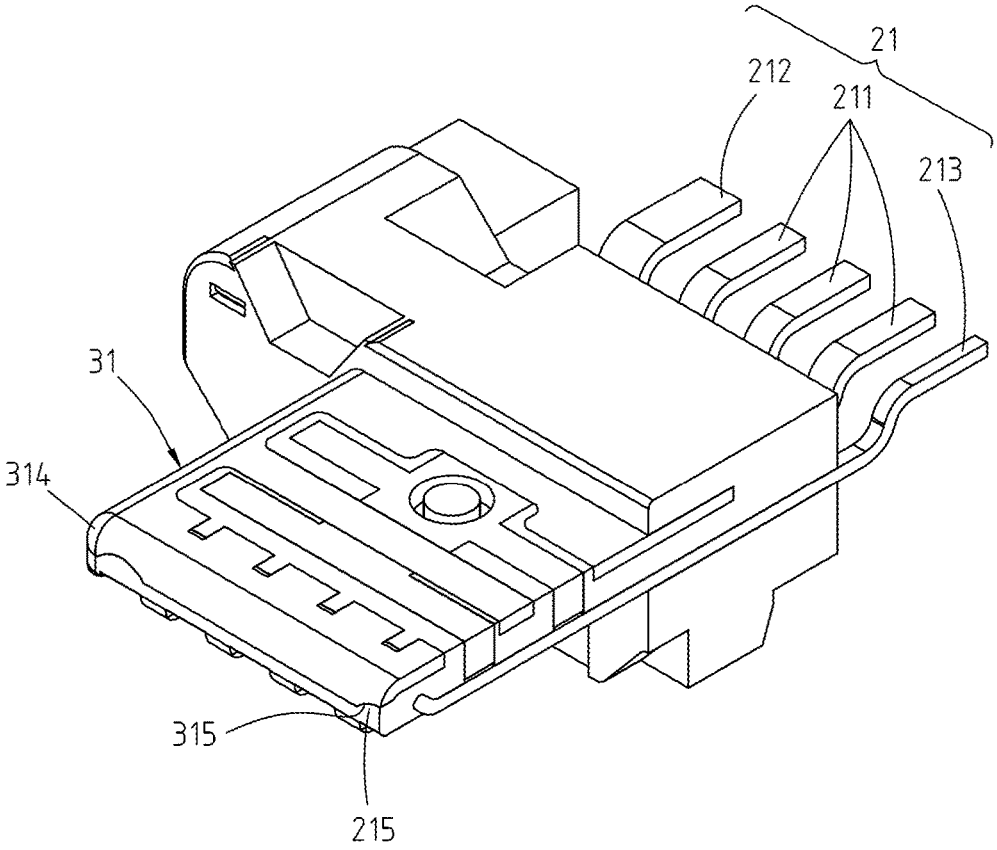
FIG. 6 is a partial perspective view of the present invention.

Referring to FIGS. 3 and 3A, the insulation housing 11 mainly comprises a substrate 12 and a tongue portion 13. And the substrate 12 and the tongue portion 13 are integrally formed in one-piece member, wherein the tongue portion 13 extends to one side of the substrate 12. Moreover, the tongue portion 13 is a flat and elongated portion, and comprises a top surface 13*a*, a bottom surface 13*b*, and a front side surface 13*c* between the top surface 13*a* and the bottom surface 13*b*, wherein the front side surface 13*c* is a plugging surface adjacent to the shell 41.

Referring to FIGS. 3 and 3A, the terminal group 21 is provided on the bottom surface 13*b*, and the terminal group 21 mainly comprises multiple signal terminals 211, a power supply terminal 212, and a grounding terminal 213. The power supply terminal 212 and the grounding terminal 213 are respectively provided at two sides of the multiple signal terminals 211, and the multiple signal terminals 211, the power supply terminal 212, and the grounding terminal 213 are sequentially arranged on the bottom surface 13*b* with interval.

The multiple signal terminals 211, the power supply terminal 212, and the grounding terminal 213 each have a plugging path P1 for plug-in, a contact wall 215 is formed between the power supply terminal 212 and the front side surface 13*c*, and the contact wall 215 is provided on the plugging path P1. Herein, the contact wall 215 mainly comprises a first abutting surface 2151 and a second abutting surface 2152 that are connected with each other. The first abutting surface 2151 is provided on the bottom surface 13*b*, the second abutting surface 2152 is provided on the front side surface 13*c*, and the first abutting surface 2151 is actually vertical to the second abutting surface 2152, but the present invention is not limited thereto.

Referring to FIGS. 3A, 4, 5 and 6, the reinforcing sheet 31 is a metal plate and is provided on the top surface 13*a*. When the insulation housing 11 is formed by injection-molding, the reinforcing sheet 31 is connected therewith, but the present invention is not limited thereto.

In this embodiment, the reinforcing sheet 31 mainly comprises a body portion 311, a front baffle 312, and recessed portions 315. The front baffle 312 bends towards a front side of the body portion 311, and the front baffle 312 and the body portion 311 are integrally formed.

The body portion 311 is fixed on the top surface 13*a* and covers the top surface 13*a*. The front baffle 312 is fixed on the front side surface 13*c*, aligned with the front side surface 13*c*, and covers the front side surface 13*c* of the tongue portion 13. Moreover, an edge 3121 of the front baffle 312 is formed with a horizontal plane and is embedded on an approximately central position of the front side surface 13*c*; however, the present invention is not limited thereto. In addition, the body portion 311 is actually vertical to the front baffle 312.

Figure 7:
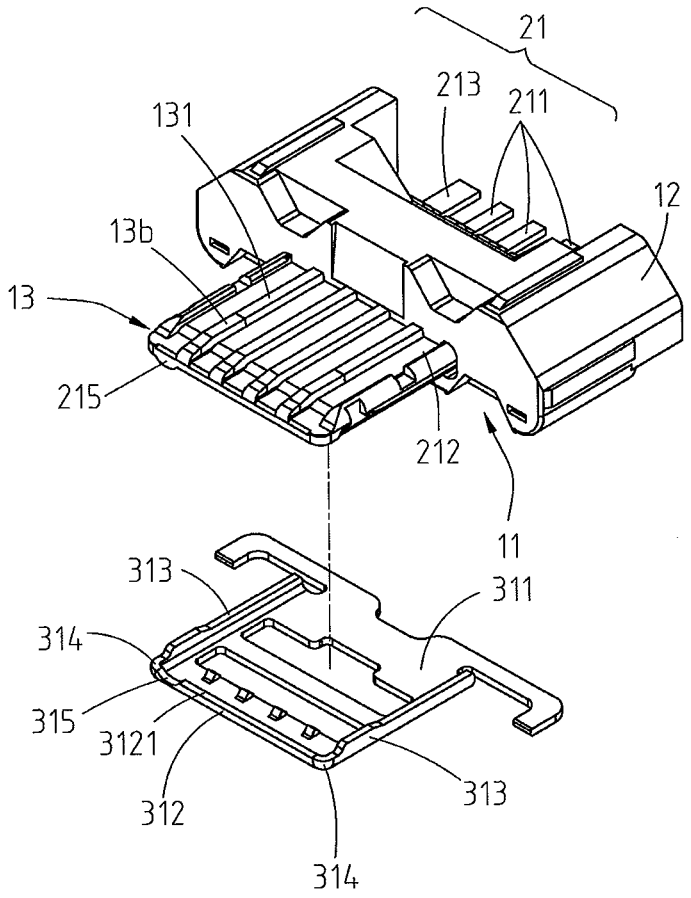
FIG. 7 is an exploded view showing a recessed portion.
Figure 8:
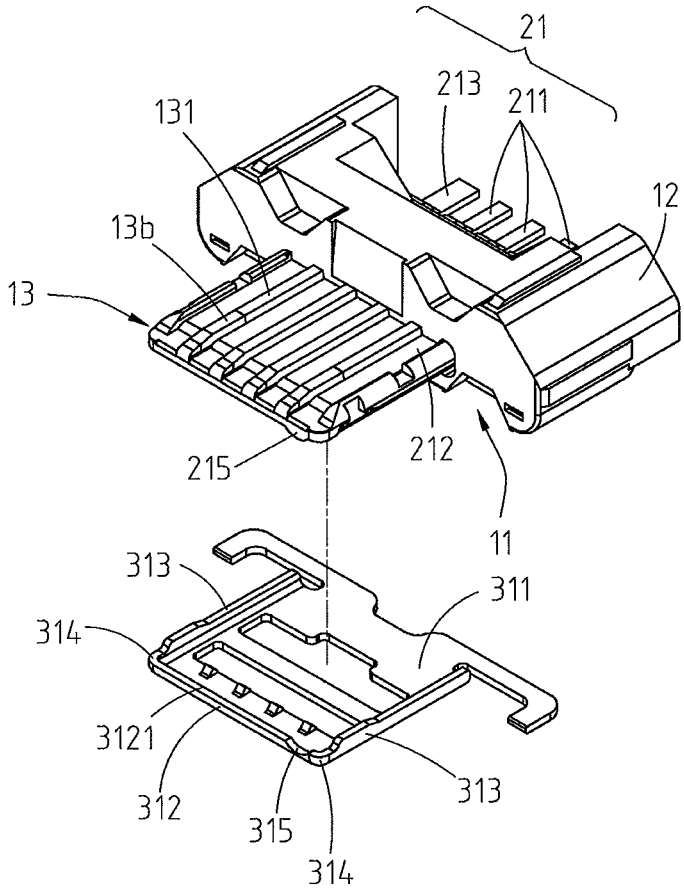
FIG. 8 is another exploded view showing the recessed portion.

Each recessed portion 315 inwardly curves to be formed on the front baffle 312 and corresponds to the contact wall 215. The recessed portion 315 may be a semi-circular slot or a squared slot, and an inner surface of the recessed portion 315 is lower than the edge 3121 of the front baffle 312 at the horizontal height. The multiple recessed portions 315 may be disposed at two sides of the front baffle 312, and the two-side recessed portions 315 respectively correspond to the contact wall 215 in the front of the power supply terminal 212 and that in the front of the grounding terminal 213. However, the present invention is not limited thereto. In some embodiments, at least one recessed portion 315 may be disposed at one side of the front baffle 312, which may correspond to the contact wall 215 in the front of the power supply terminal 212 or that in the front of the grounding terminal 213 (as shown in FIGS. 7 and 8).

When an electrical plug connector (not shown) is plugged into the electrical receptacle connector 100, multiple conductive terminals of the electrical plug connector are inserted through the plugging path P1, and then sequentially rub the contact wall 215, and finally contact the power supply terminal 212 and the grounding terminal 213. When the electrical plug connector is unplugged from the electrical receptacle connector, the multiple conductive terminals of the electrical plug connector withdraw through the plugging path P1, and rub the contact wall 215 again, causing that the contact wall 215 is concaved from a flat plane to a slot.

Since the inner surface of the recessed portion 315 of the reinforcing sheet 31 is lower than the edge 3121 of the front baffle 312 at the horizontal height, the distance from each conductive terminal to the inner surface of the recessed portion 315 can be prolonged, so that the conductive terminals cannot contact the inner surface of the recessed portion 315 when rubbing the contact wall 215; in this way, after the electrical plug connector is plugged in and unplugged out many times, the conductive terminals are prevented from contacting the inner surface of the recessed portion 315 of the reinforcing sheet 31 when being inserted into the concave contact wall 215. In a word, after the electrical plug connector is connected to the electrical receptacle connector 100, the reinforcing sheet 31, the shell 41, and the electrical plug connector are connected together, and if the conductive terminals contact the reinforcing sheet 31, a short circuit occurs in the electronic product.

Referring to FIGS. 3 and 3A, the contact wall 215 is further provided with a bump 2153, and the bump 2153 may be formed by filling the recessed portion 315 with plastic after the insulation housing 11 is injection-molded. In the other words, the contact wall 215 is formed within a region among a partial bottom surface 13*b* in front of the power supply terminal 212 a partial front side surface 13*c* and the bump 2153. The bump 2153 increases the thickness and distance to contact the contact wall surface 215, which may reduce the short circuit risk caused by the reinforcing sheet 31 contacting the conductive terminals; moreover, the bump 2153 is securely combined to the recessed portion 315 to improve the firmness. The bump 2153 projects from the top surface 13*a* of the tongue portion 13 near the front side surface 13 of the tongue portion 13, and the bump 2153 is corresponding to the power supply terminal 212. Referring to FIGS. 7 and 3A, it is known that the contact wall 215 is formed within a region among a partial bottom surface 13*b* in front of the grounding terminal 213 a partial front side surface 13*c* and the bump 2153. The bump 2153 projects from the top surface 13*a* of the tongue portion 13 near the front side surface 13 of the tongue portion 13, and the bump 2153 is corresponding to the grounding terminal 212.

Referring to FIGS. 3 and 3A, the reinforcing sheet 31 is further provided with multiple side baffles 313 and corner baffles 314, where the multiple side baffles 313 are disposed on two side surfaces 13*d* of the tongue portion 13 and covers the side surfaces 13*d*. The two side surfaces 13*d* are located between the top surface 13*a* and the bottom surface 13*b*. The corner baffles 314 connect with the side baffles 313 and the front baffle 312 to form a whole body. Each corner baffle 314 is located and connected between the front baffle 312 and the corresponding side baffle 313, and covers a corresponding corner formed by the meeting of the front side surface 13*c* and the side surface 13*d* of the tongue portion 13. However, the present invention is not limited thereto. In some embodiments, the corner baffles 314 may be saved, and the front baffle 312 and the side baffles 313 are merely provided. In the present invention, the side baffles 313, the corner baffles 314, and the front baffle 312 are integrally connected and fixed on the tongue portion 13, thereby increasing the strength of the tongue portion 13 and preventing the tongue portion 13 from fracturing during plugging and unplugging.

Referring to FIGS. 3 and 3A, the tongue portion 13 is further provided with multiple separators 131, which are provided on the bottom surface 13*b* and separate the multiple signal terminals 211, the power supply terminal 212, and the grounding terminal 213. When the multiple conductive terminals of the electrical plug connector are inserted, the terminals not matching are prevented from contacting each other through the separation of the separator 131, which may further prevent occurring an electrostatic interference signal.

In the present invention, a recessed portion inwardly curves to be formed on a front baffle and corresponds to a contact wall, and an inner surface of the recessed portion is lower than an edge of the front baffle at the horizontal height; in this way, after an electrical plug connector is plugged in and unplugged many times, conductive terminals are prevented from contacting the inner surface of the recessed portion of a reinforcing sheet when being inserted into the concave contact wall, thereby avoiding a short circuit of an electronic product if the conductive terminals contact the reinforcing sheet. Moreover, the contact wall is provided with a bump structure fit with the recessed portion, and the bump increases the thickness and distance to rub the contact wall, thereby reducing the short circuit risk caused by the reinforcing sheet contacting the conductive terminals. In addition, the side baffles, the corner baffles, and the front baffle of the reinforcing sheet are integrally connected and fixed on the tongue portion, thereby increasing the strength of the tongue portion and preventing the tongue portion from fracturing during plugging and unplugging.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A reinforcing structure of an electrical receptacle connector, comprising:

an insulation housing, comprising:

a substrate; and a tongue portion extending to one side of the substrate, wherein the tongue portion comprises a top surface, a bottom surface, two side surfaces, and a front side surface, wherein the front side surface and the two side surfaces are located between the top surface and the bottom surface;

a terminal group disposed on the bottom surface, wherein the terminal group comprises a power supply terminal and a grounding terminal;

a reinforcing sheet disposed on the top surface and comprising:

a front baffle covering the front side surface of the tongue portion and having a recessed portion inwardly curved thereon, wherein an inner surface of the recessed portion of the reinforcing sheet is lower than an edge of the front baffle at a horizontal height;

two side baffles covering the two side surfaces of the tongue portion respectively; and two corner baffles, each corner baffle located and connected between the front baffle and the corresponding side baffle and covering a corresponding corner formed by the meeting of the front side surface and the side surface of the tongue portion; and a wherein a bump projects from the top surface of the tongue portion near the front side surface of the tongue portion corresponding to the power supply terminal and is fitted with the recessed portion.

2. The reinforcing structure of an electrical receptacle connector according to claim 1, wherein a contact wall is formed within a region among a partial bottom surface in front of the power supply terminal, a partial front side surface and the bump and comprises a first abutting surface and a second abutting surface connected with each other, and wherein the first abutting surface is disposed on the bottom surface, and the second abutting surface is disposed on the front side surface.

3. The reinforcing structure of an electrical receptacle connector according to claim 1, wherein the bump is utilized to increase the thickness between the top surface and the bottom surface near the front side surface to reduce the short circuit risk caused by the reinforcing sheet and the power supply terminal.

4. A reinforcing structure of an electrical receptacle connector, comprising:

an insulation housing, comprising:

a substrate; and a tongue portion extending to one side of the substrate, wherein the tongue portion comprises a top surface, a bottom surface, two side surfaces, and a front side surface, wherein the front side surface and two side surfaces are located between the top surface and the bottom surface;

a terminal group disposed on the bottom surface, wherein the terminal group comprises a power supply terminal and a grounding terminal;

a reinforcing sheet disposed on the top surface and comprising:

a front baffle on covering the front side surface of the tongue portion and having a recessed portion inwardly curved thereon, wherein an inner surface of the recessed portion of the reinforcing sheet is lower than an edge of the front baffle at a horizontal height;

two side baffles covering the two sides surfaces of the tongue portion respectively; and two corner baffles, each corner baffle located and connected between the front baffle and the corresponding side baffle and covering a corresponding corner formed by the meeting of the front side surface and the side surface of the tongue portion; and wherein a bump projects from the top surface of the tongue portion near the front side surface of the tongue portion corresponding to the grounding terminal and is fitted with the recessed portion.

5. The reinforcing structure of an electrical receptacle connector according to claim 4, wherein a contact wall is formed within a region among a partial bottom surface in front of the grounding terminal, a partial front side surface and the bump and comprises a first abutting surface and a second abutting surface that are connected, and wherein the first abutting surface is disposed on the bottom surface, and the second abutting surface is disposed on the front side surface.

* * * * *